United States Patent [19]

Cameron

[11] Patent Number: 5,025,729

[45] Date of Patent: Jun. 25, 1991

[54] AERIAL DISTRESS FLARE

[76] Inventor: Robert W. Cameron, 1321 King St., Bellingham, Wash. 98226

[21] Appl. No.: 482,877

[22] Filed: Feb. 21, 1990

[51] Int. Cl.[5] ..... F42B 4/26

[52] U.S. Cl. ..... 102/336; 102/351; 102/356; 102/360; 102/361; 102/505; 342/5

[58] Field of Search ..... 102/336, 351, 356, 360, 102/361, 505; 342/5

[56] References Cited

U.S. PATENT DOCUMENTS

| | | | |
|---|---|---|---|
| 4,299,166 | 11/1981 | Carnigan et al. | 102/501 |
| 4,791,870 | 12/1988 | Simpson | 102/351 X |
| 4,852,453 | 8/1989 | Morin | 102/505 X |
| 4,852,456 | 8/1989 | Thornburg | 102/505 X |
| 4,860,657 | 8/1989 | Steinicke et al. | 102/505 X |

*Primary Examiner*—Peter A. Nelson
*Attorney, Agent, or Firm*—Hughes & Multer

[57] ABSTRACT

An emergency signalling device comprising an elongate shell to be fired into the air. The shell encloses a combustible propellant charge, combustible material for generating a visible smoke trail, combustible material for generating a visible spark trail, at least one explosive charge for generating an audible report, a multiplicity of radar chaff particles, and an explosive ejection charge for distributing the radar chaff particles from the shell once the shell has been propelled beyond a predetermined altitude. An ignitor wire is provided which is in contact with the propellant charge. The shell is enclosed in a barrel for storage and launching. The barrel has an external thumbstop to prevent recoil from pushing the barrel back through the hand of the operator. There is a bulkhead at the closed lower end of the barrel, on which are mounted electrical contacts connected to the ends of the ignitor wire. A cap is threadably engaged with the lower end of the barrel, and has a battery therein which has contacts on the inner surface of the cap. The end cap is manually tightened against the lower end of the barrel to bring the contacts into abutment with one another, igniting the propellant charge. The shell has stabilizer fins with flexible portions which are folded circumferentially between the shell and the barrel, and which are released and extend radially when the shell is launched.

21 Claims, 2 Drawing Sheets

AERIAL DISTRESS FLARE

BACKGROUND OF THE INVENTION

1. Field of the Invention

The present invention relates generally to signalling devices. More particularly, the present invention relates to an emergency signalling flare.

2. Background Art

Distress signalling devices frequently play a critical role in the effective rescue of, or rendering of assistance to, personnel in emergency situations. In a typical scenario, an individual, or a group of individuals, may be lost in a land area or on a body of water. Often, such persons are subjected to severe cold and exposure, and, accordingly, expeditious rendering of aid is usually crucial. Perhaps the single most important factor impacting the overall time required to bring aid to such a person is the amount of time required to identify the person's location.

A number of devices and techniques are known for assisting in determining the location of a person requiring aid. One broad category of such devices are those which render the location of the person more visible to those about him, including both casual observers and active searchers. Some such devices include flares, such as parachute flares, floating flares, and ground resting flares which generate a bright light. Other such devices include smoke markers and smoke floats which generate a cloud of smoke about the location of the emergency.

A number of deficiencies have been encountered in the use of such conventional emergency signalling devices. For example, it is known that typical flares, which usually generate a bright point of light, frequently fail to be noticed by casual observers who are not actively searching for the emergency location. For example, it is not unusual for persons in distress at sea to fire flares which function normally, but which nevertheless fail to be noticed by personnel on board passing craft, even though some of the larger of such craft maintain both visual and radar lookouts. This deficiency is particularly pronounced during daytime, when the light emitted by the flare may not be noticed by a person against bright sunlight, unless the person is looking directly towards the general location of the flare.

A further deficiency of such conventional flares lies in the fact that they typically generate a point source of light. Even if an observer notices such a point source of light, it is often very difficult for a single observer to ascertain the exact location of the flare itself, to say nothing of the origin from which the flare was fired, without triangulation of the point based on observations made by two persons at different locations. Furthermore, conventional flares which are fired into the air typically do not leave a significant trail of smoke which an observer could effectively track back to the point of origin. Usually, there is only a weak or nonexistent incidental trail of smoke from the burning propellant charge which, even in daytime, is generally insufficient for an observer to track the path of the flare back to its source. At night, of course, such a smoke trail would be virtually useless to an observer trying to determine the firing point of the flare. Accordingly, it will be understood that with typical conventional flares, it is often very difficult for an observer to determine the point of their origin, and hence the location of the person requiring assistance.

Yet another deficiency of conventional flares is often encountered when using conventional hand held flares which launch projectiles, such as parachute flares, aloft. Commonly, such hand held flares have a small chain depending from their lower end which is pulled by an operator to fire the flare. In practice, this small chain is often very difficult to grip with cold and/or wet hands, which is precisely the condition of the hands of many of the persons requiring emergency assistance. Furthermore, the exterior of such conventional hand held flares typically takes the form of a smooth-sided cylinder. While this form may readily fit in the hand of an operator, it is often very difficult to prevent the cylinder from slipping longitudinally through the hand of the operator, particularly if it or the hand is wet. Consequently, this configuration not only complicates activation of the flare by a person attempting to pull on the typical firing chain, but it also often permits the recoil of the barrel (which results from the launch of the flare from within the barrel) to drive the barrel longitudinally rearward through the operator's hand, so that the mouth of the barrel ends up near or within the operator's fingers, which may result in serious burns.

Accordingly, there is a need for an emergency signalling device which will be more readily noticed by observers, and which will permit such observers to determine the point of origin of the device. Furthermore, there is a need for such a device which is easier for a person in distress to operate, as well as one which can be operated by such person with less risk of injury to the person's hands.

SUMMARY OF THE INVENTION

The present invention has solved the problems cited above, and comprises an emergency signalling device having a generally elongate shell, within which is enclosed a propellant charge for propelling the shell aloft when ignited, means for generating a smoke trail as the shell is propelled aloft, means for generating a spark trail as the shell is propelled aloft, and means for generating at least one audible report once the shell has been propelled aloft beyond a predetermined altitude. A multiplicity of radar chaff particles are enclosed in the shell, as well as means for distributing the radar chaff particles from the shell once the shell has been propelled aloft beyond a predetermined altitude.

The means for generating a smoke trail may be a multiplicity of particles of combustible smoke-generating material interspersed amongst the propellant charge, and the means for generating a trail of sparks may be a multiplicity of particles of magnesium interspersed amongst the propellant. The means for generating an audible report may be an explosive charge, such as a detonator or firecracker. The explosive charge is embedded within the propellant charge and has a fuse exposed to the propellant charge, so that the explosive charge is ignited and ejected from the shell as it is propelled aloft by the combustion of the ignited propellant.

The multiplicity of particles of radar chaff are encased in a nose compartment at an upper end of the shell, which may be formed within a generally conical nose cap. An explosive ejection charge is mounted in the shell intermediate the propellant charge and the nose compartment for ejecting the radar chaff, and may have a lower face in contact with the upper end of the propellant charge, so that the ejection charge is ignited when the propellant charge has been substantially depleted.

A barrel is provided for launching the shell. The barrel encloses the shell, and has an upper end which is sealed by a pierceable membrane and a lower end which is sealed by a bulkhead. A thumbstop is mounted on the exterior of the barrel for reacting against a thumb of the hand of an operator, so as to prevent the recoil of the barrel from driving the barrel back through the operator's hand.

A plurality of stabilizing fins are mounted to the exterior of the shell. Each fin has a base portion mounted to the shell and a flexible blade portion which is folded circumferentially against the exterior of the shell intermediate the shell and the barrel. When the shell is launched, the flexible blade portion is released and extends radially from the shell.

The means for igniting the propellant charge may be an ignitor wire which passes through an orifice in a base plug of the shell so that a middle portion of the ignitor wire is in contact with the propellant charge. The ignitor wire has first and second ends which are electrically connected to contacts which are mounted on the outer surface of the bulkhead at the base of the barrel. An end cap is threadably engaged with the lower end of the barrel, and has a battery mounted therein so that the first and second poles of the battery are connected to contacts at an inner surface of the end cap, which inner surface faces the outer surface of the bulkhead on the barrel. A removable band is mounted circumferentially around a portion of the threads on the lower end of the barrel, so as to maintain a gap between the battery and ignitor wire contacts, by preventing the end cap from being tightened against the barrel until ignition is desired. A pull tab may be provided on the removable band to facilitate its removal by an operator.

To ignite the flare, the operator removes the removable band from around the threads, and tightens the end cap against the lower end of the barrel. This brings the contacts which are electrically connected to the battery into abutment with the contacts which are electrically connected to the ignitor wire, so as to complete an electrical circuit from the first pole of the battery to the second pole of the battery through the ignitor wire. The middle portion of the ignitor wire, which is in contact with the propellant charge, is thus heated so as to ignite the propellant charge.

Other features of the present invention will become apparent from the following detailed description.

DETAILED DESCRIPTION OF THE INVENTION

Figure 1:
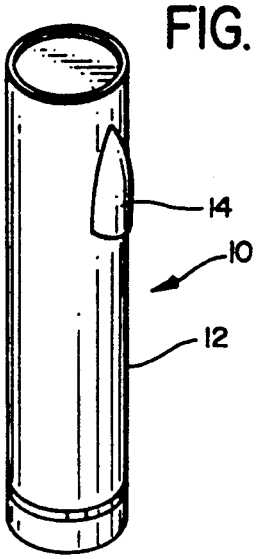
FIG. 1 is a perspective view of an emergency signalling device incorporating the present invention.

FIG. 1 shows the exterior of an emergency signalling device incorporating the present invention. Signalling device 10 is preferably provided with a substantially cylindrical barrel 12, which is of a suitable size to be grasped in one hand by an operator. The cylindrical barrel has an upper end, which is to be pointed towards the sky when firing the device, and a lower end. Proximate the upper end of the barrel is a protruding thumbstop 14. Thumbstop 14 reacts against the thumb of the hand of the operator so as to prevent the recoil which results from firing the device from driving the barrel rearwardly through the operator's hand. As noted above with reference to conventional hand-held flares, such backward motion, if unchecked, may result in burning of the hands of the operator. Thumbstop 14 is preferably provided at a suitable location such that it will abut longitudinally against the end of the operator's thumb when the operator grasps the barrel with his thumb outstretched in an upward direction. Thumbstop 14 may preferably be provided with a concave indentation (not shown) on its lower face, for conveniently and securely receiving the operator's thumb. The thumbstop may be modified to other configurations, as desired, to react against the thumb or other parts of the operator's hand; for example, it may be desirable in some embodiments of the present invention to form the thumbstop as a circumferential shoulder about barrel 12.

Figure 2:
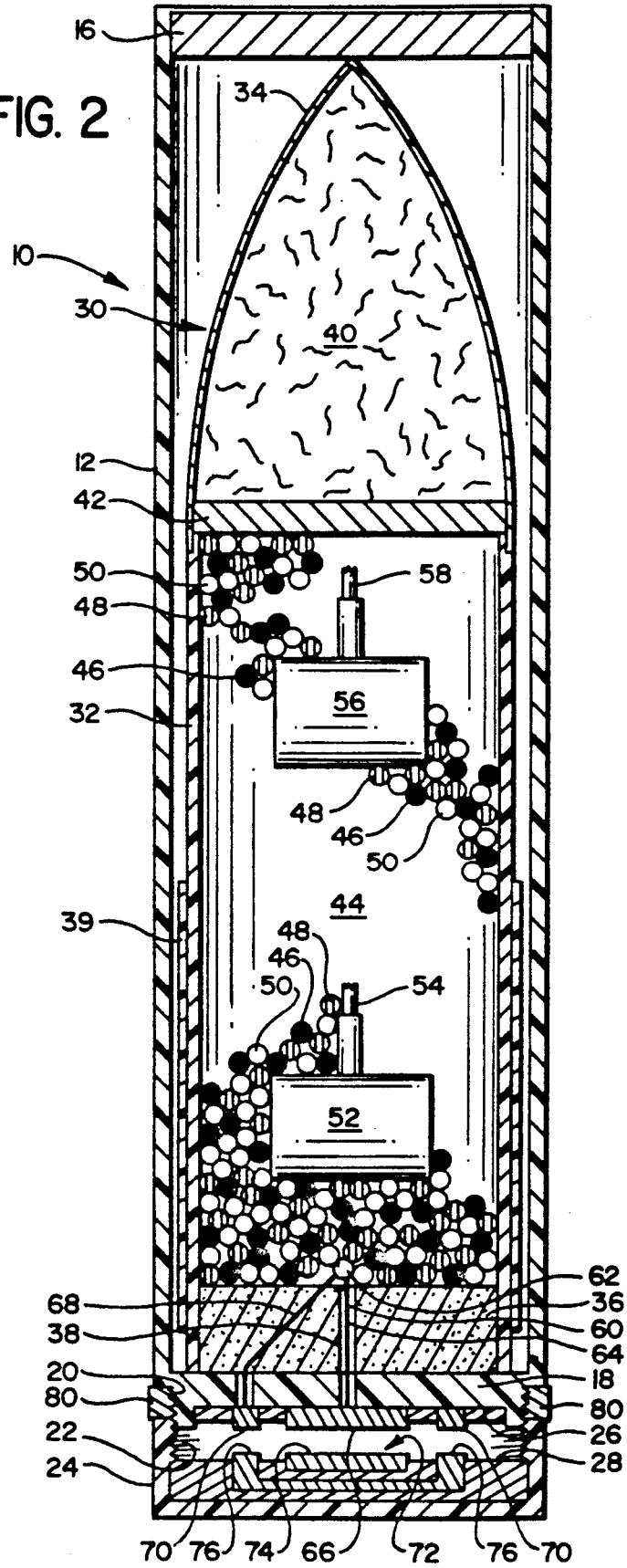
FIG. 2 is an elevational view of the device of FIG. 1, with this being a sectional view taken through the longitudinal center line of the device.

With reference now to FIG. 2, which is a sectional view of the emergency signalling device shown in FIG. 1, there is shown emergency signalling device 10 having barrel 12. Barrel 12, as noted above, is preferably a substantially cylindrical barrel, and has an inner surface which defines a bore. As also noted above, barrel 12 has an upper end which is to be pointed skyward when firing the device. The upper end of barrel 12 is sealed by a pierceable membrane 16, through which the projectile encased within barrel 12 may pass upon firing of the device. Membrane 16 may be made of any suitable material, such as, for example, wax, thin paper or plastic, and the like, which will protect the projectile from damage and deterioration during storage, yet which will fracture, split, rupture, or otherwise permit passage of the projectile therethrough upon lauching. Barrel 12 also has a lower end, which is sealed by a bulkhead 18. Barrel 12, as well as bulkhead 18, may be constructed of any suitable material possessing adequate stiffness to retain and protect the projectile enclosed therein during storage and handling, as well as sufficient strength to support and guide the projectile during its launching. For example, barrel 12 may be made of heavy cardboard or, as another example, barrel 12 may be made of injection molded plastic and have bulkhead 18 cast integrally therewith.

Threads 20 are formed on the lower end of barrel 12, preferably about the exterior thereof. Threads 20 are engaged by threads 22 on end cap 24. End cap 24, which may be made of any suitable material, such as injection molded plastic, has generally an open mouth at its upper end, a closed lower end, and substantially cylindrical sides. It is preferable that end cap 24 form, in essence, a continuous extension of the exterior of barrel 12 when installed on the lower end thereof. Accordingly, end cap 24 is easily grasped by the operator, even with cold, wet hands, and rotated relative to barrel 12, so as to tighten end cap 24 against barrel 12. The exterior of end cap 24 may be provided with knurling, ribs, or other surface features which further enhance ease of operation.

With further reference to FIG. 2, it will be seen that bulkhead 18 of barrel 12 has an outer surface 26, which faces away from propellant charge 44. End cap 24 has an inner surface 28 which faces towards surface 26 on bulkhead 18. Accordingly, surfaces 26 and 28 oppose, or face towards each other, and will move towards each other when end cap 24 is rotated relative to barrel 12 by an operator so as to tighten end cap 24 against the end of barrel 12.

Having described the barrel assembly, attention is next directed to the shell assembly which is enclosed within barrel 12. FIG. 2 shows a shell assembly 30, which is most preferably provided in the shape generally of a typical projectile or rocket so as to have suitable aerodynamic characteristics to be propelled a significant distance aloft. Shell assembly 30 preferably comprises a substantially cylindrical shell casing 32. Shell casing 32 may be made of any suitable material, such as cardboard or plastic, and is sufficiently strong so as to resist high temperatures and pressures generated by the combustion of the propellant charge encased therein during the ascent of the shell assembly, so as to properly direct the generated gasses out of the lower end of the casing. At the upper end of shell casing 32 is a nose cap or nose cone 34. Nose cone 34 is hollow, so as to form a nose compartment therein, and is preferably constructed of a light weight material which is easily ruptured, as by an explosion or increase of internal pressure. To render nose cone 34 easier to rupture, it may be suitably scored or striated. Nose cone 34 preferably has a ogival shape so as to provide suitable aerodynamic characteristics.

The lower end of shell casing 32 is closed by a base plug 36. Base plug 36 may be constructed so as to be eroded or blown out of the base of the shell when the propellant charge is ignited and burns. For example, suitable materials for a construction of base plug 36 include clay or stiff cardboard. A central orifice 38 extends longitudinally through base plug 36. Base plug 36 and orifice 38 may take the form of a clay nozzle for directing the propellant gases out of the base of casing 32, provided that orifice 38 is of sufficient diameter, as will be discussed below.

Mounted on the exterior of shell casing 32 are stabilizing fins 39. As will be described in greater detail below, fins 39 are folded circumferentially about the exterior of shell casing 32 so as to fit between shell casing 32 and the interior wall of barrel 12 during storage.

Having described the shell casing and other exterior components of shell assembly 30, attention is now directed to the contents thereof. With further reference to FIG. 2, there is shown a mass or multiplicity of chaff particles 40 encased or enclosed in the nose compartment formed by nose cone 34. Radar chaff, as is known to those skilled in the art, is a material suitable for forming an airborne mass of particles which provide a very strong return to projected radar signals. Accordingly, a cloud of radar chaff typically produces a very pronounced image on a radar scope, which image may readily be spotted and precisely located by an operator. Typical materials for use as radar chaff are small strips of aluminum foil or aluminized mylar, which are very light in weight and fall very slowly through the atmosphere, thus forming a long lasting chaff cloud for observation by radar. A suitable explosive ejection charge 42 is provided to distribute radar chaff particles 40 by providing a small explosion which ruptures nose cone 34, releasing radar chaff particles 40 into the atmosphere. In the embodiment shown in FIG. 2, ejection charge 42 is a disc of explosive material which forms a lower bulkhead between the nose compartment containing radar chaff 40 and the propellant charge enclosed within shell casing 32. It will be recognized, however, that a small explosive charge having any suitable shape may be used to distribute radar chaff 40.

As noted above, explosive ejection charge 42 preferably forms a bulkhead between the nose compartment of the shell assembly and the propellant charge enclosed within shell casing 32; accordingly, explosive ejection charge 42 has a lower surface which is exposed to and in contact with combustible propellant charge 44. Propellant charge 44 may be made up of any suitable combustible propellant material, such as, for example, compressed or particulate black powder, or other suitable propellants known to those skilled in the art, such as military solid propellants. Propellant charge 44 may be made up of a multiplicity of solid propellant particles 46. Propellant particles 46 are represented by black circles in the propellant charge 44 shown in FIG. 2. As will be described below, ignition of propellant charge 44 is most preferably initiated at the lower end thereof, proximate base plug 36. As propellant charge 44 subsequently burns, it generates gases which, in a conventional manner, are forced out the lower end of shell assembly 30, so as to propel shell assembly 30 aloft. Propellant charge 44 burns progressively in a longitudinal direction within shell casing 32; accordingly, as shell casing 30 is propelled further and further aloft, a combustion front will burn further and further longitudinally (upwardly in FIG. 2) through propellant charge 44. When the propellant charge is substantially depleted, i.e., when shell assembly 30 has substantially reached the highest point of its trajectory, (which may preferably be at an altitude of approximately 2000 feet), the combustion front will contact explosive ejection charge 42, causing ejection charge 42 to detonate and expel radar chaff particles 40, so as to form a chaff cloud at a suitably high altitude. Since the radar chaff cloud is thus formed at a high altitude, the radar chaff cloud will persist for an extended period prior to falling back onto the ground or sea. During this extended period, the radar chaff cloud will provide a strong radar return which may readily be spotted by a radar operator, so as to determine the exact location of the emergency site.

Interspersed within propellant charge 44 is a smoke-generating material for generating a smoke trail from shell assembly 30 as it is propelled aloft by the combustion of propellant charge 44. If, as was described above, the propellant comprises a multiplicity of particles of solid propellant fuel, the smoke-generating material may preferably be formed into a multiplicity of particles of solid smoke-generating material 48 which are interspersed amongst the propellant particles 46. In propellant charge 44 shown in FIG. 2, combustible smoke-generating particles 48 are represented by shaded circles. Combustible smoke-generating materials are well known to those skilled in the art; for example, white smoke is often derived from red phosphorous, or from the combustion of aluminum with hexachloroethane and zinc oxide, while colored smokes often derive their color from organic dyes, such substituted anthroquinones, which evaporate and recondense when combusted. For use in the present invention, it is most preferable that a combustible smoke-generating material be selected which generates an easily visible colored smoke, such as yellow or bright orange smoke, so as to render it more easily spotted and tracked by an observer, particularly under hazy atmosphere conditions. Combustible smoke generating particles 48 burn progressively as the combustion front burns longitudinally through the propellant charge 44, so that shell assembly 30 preferably generates a continuous smoke trail from its launch site to the apex of its trajectory; accordingly, during daylight hours, an observer can easily spot the smoke trail and trace it back to its origin so as to visually determine the exact location of the emergency site.

During nighttime hours, or under dark or rainy conditions, it may be difficult or impossible to visually spot a smoke trail. Accordingly, the emergency signalling device of the present invention is provided with means for generating a spark trail as well. With further reference to FIG. 2, it will be seen that a combustible spark-generating material is intermixed within propellant charge 44. Preferably, the spark-generating material comprises a multiplicity of magnesium particles 50 which are intermixed amongst the propellant particles 46 and the combustible smoke-generating particles 48. In the propellant charge 44 shown in FIG. 2, magnesium particles 50 are represented by white circles. In a manner similar to that described above with respect to the generation of the smoke trail, magnesium particles 50 are progressively ignited and ejected from the bottom of shell assembly 30 as it is propelled aloft. As magnesium particles 50 burn, they generate brilliant sparks which are easily seen by an observer. As is known to those skilled in the art, magnesium/alkali nitrate flares are particularly effective at maximizing the brightness in the visible light region. It should be noted, however, that a wide variety of other, well known combustible spark-generating materials may be substituted for the magnesium particles, including, for example, pyroaluminum, cast iron turnings, or coarse titanium. Furthermore, because the human eye has great sensitivity to the yellow sodium emission, it may be desirable to combine a portion of sodium nitrate with the magnesium powder.

As magnesium particles 50 are progressively burned and ejected from shell assembly 30 as it is propelled aloft, they generate a continuous spark trail from the launch site to the apex of the trajectory of the shell. Accordingly, in a manner similar to that which was described with respect to the smoke trail which is provided for daytime spotting, a nighttime observer can easily spot the spark trail and trace it back to its origin so as to visually determine the exact location of the emergency site.

As was discussed above, a common deficiency encountered with the use of conventional emergency signalling flares is that, even if they generate bright light or smoke, they may not be noticed by a casual observer, especially if they are behind the observer or in the periphery of his view. Accordingly, the emergency signalling device of the present invention is provided with means for generating a powerful report with which to draw the observer's attention to its general location. With further reference to FIG. 2, there is shown an explosive report-generating charge 52 which is embedded within propellant charge 44. Report charge 52 may preferably be a conventional detonator or firecracker (for example, report charge 52 may be a firecracker of the type commonly referred to as an "M-80"), which generates a very loud report, and may preferably also generate a flash of light. The sound of the report, and the flash of light (if it is at least within the periphery of the observer's view), will draw the observer's attention to the general location of shell assembly 30 as it is propelled aloft, so that the observer can then spot and track the smoke or spark trail generated from the shell. Report charge 52 preferably has a combustible fuse 54 which is exposed to the propellant charge 44 in which report charge 52 is embedded; accordingly, as the combustion front described above progresses longitudinally through propellant charge 44, the combustion front will ignite fuse 54 and eject report charge 52 as shell assembly 30 is propelled aloft past a predetermined altitude. Most preferably, report charge 52 may be ignited and ejected as shell assembly 30 is propelled past an altitude of approximately 50 feet, so as to call attention to the signalling device relatively early in its flight, particularly before the smoke and spark trails may be dissipated. Shell assembly 30 may also preferably be provided with a second report charge 56, which is similarly embedded in propellant charge 44 with a fuse 58 exposed thereto, but is located in propellant charge 44 at a longitudinal distance from base plug 36 which is greater than the longitudinal distance between first report charge 52 and base plug 36. Accordingly, second report charge 56 will be ignited and ejected from shell assembly 30 as it is propelled past a higher altitude than that at which first report charge 52 was ignited and ejected; preferably, second report charge 56 is positioned within propellant charge 44 so that second report charge 56 is ignited and ejected from shell assembly 30 at an altitude of approximately 600 feet, at which relatively high elevation the report may be detectable by observers at relatively greater distances. The exhaust opening at the base of shell assembly 30, whether formed by orifice 38, should be large enough to permit the report charges to pass therethrough without impediment.

Having described the external and internal components of shell assembly 30, attention will now be directed to the means for igniting the propellant charge of the shell. With further reference to FIG. 2, there is shown an ignitor wire 60, which is routed through orifice 38 in base plug 36, so that middle portion 62 of ignitor wire 60 is in contact with propellant charge 44. As is known to those skilled in the art, ignitor wire 60 is an electrically conductive wire, which becomes very hot, and may, in essence, burn or oxidize when electrical current is passed therethrough. A variety of suitable ignitor wires, electrical matches, and the like are known to those skilled in the art. In the event that electrical current is passed through ignitor wire 60 so that middle section 62 becomes hot or burns, combustion of propellant charge 44 will be initiated. Ignitor wire 60 has a first end 64 which is electrically connected to a first electrical contact 66. First electrical contact 66 is exposed at the lower end of barrel 12 on the outer surface 26 of bulkhead 18. Ignitor wire 60 also has a second end 68 which is, similarly, electrically connected to a second contact 70 mounted on outer surface 26. Mounted in end cap 24 on inner surface 28 (which faces outer surface 26 of bulkhead 18) is battery assembly 72. Battery assembly 72 may preferably be a lithium battery having a suitable strength and storage life to be able to ignite the propellant charge after a lengthy period of storage. Battery assembly 72 has first and second poles, the first pole being electrically connected to a third electrical contact 74, which is exposed at surface 28. Contact 74 may be the central circular contact of the positive pole of a typical lithium battery, in which case electrical contact 66 is preferably a corresponding centrally located disc-shaped contact which is adapted to meet flushly with contact 74. The other pole of battery assembly 72 is electrically connected to a fourth contact 76, which is also exposed at surface 28 of end cap 24. If, as described above, battery assembly 72 is a typical lithium battery, contact 76 may be the typical ring shaped contact of the negative pole of such a battery; in this case, contact 70 mounted on surface 28 may be a corresponding ring shaped contact positioned concentrically about contact 66, and adapted to bear flushly against the negative contact 76 of the lithium battery. First and second contacts 66 and 70 are mounted at surface 26, and third and fourth contacts 74 and 76 are mounted at surface 28, so that a gap is present between the battery contacts and the ignitor wire contacts prior to ignition. While it is preferable that a gap be maintained between both sets of contacts prior to ignition, it is critical that at least one electrical gap be maintained so that the circuit is not completed until ignition is desired. A gap is also provided between surface 26 and surface 28, so that surface 28 may move inwardly towards surface 26 when end cap 24 is tightened against the lower end of barrel 12. In order to maintain the gap between the contacts of the battery assembly and the contacts on the ignitor wire until ignition is desired, a detachable band 80 is fastened about the lower end of barrel 12, in contact with threads 20, so as to block or prevent the passage of the threaded mouth of end cap 24 over threads 20 a sufficient distance to bring the contacts together. As will be described in greater detail below, when ignition is desired, detachable strap 80 is removed by the operator, and end cap 24 is tightened against the end of barrel 12 so as to bring the sets of contacts into abutment with one another, thereby completing a circuit from the first pole of battery assembly 72 to the second pole of battery assembly 72 through ignitor wire 60, causing middle section 62 of ignitor wire 60 to become heated so as to ignite propellant charge 44.

Figure 3:
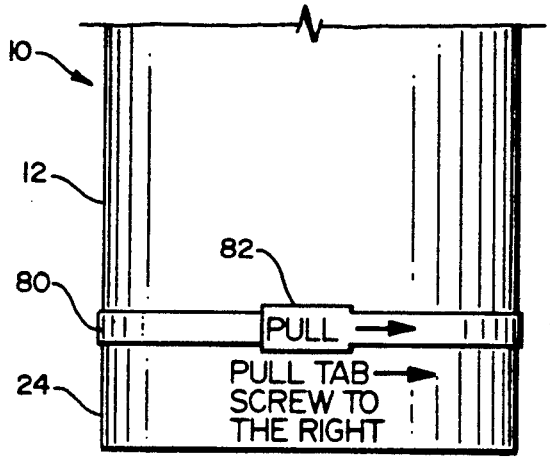
FIG. 3 is an elevational view of a portion of the lower end of the device shown in FIG. 1, prior to ignition of the propellant charge of the device.

With reference now to FIG. 3, there is shown an exterior view of the lower end of the emergency signalling device 10 of FIGS. 1 and 2. As described above, emergency signalling device 10 is provided with a barrel 12, onto the lower end of which is threaded end cap 24. Detachable band 80 is mounted circumferentially about the lower end of barrel 12 against the threads thereon, so as to prevent end cap 24 from being tightened against barrel 12 until ignition is desired. A pull-tab 82 is preferably provided to facilitate ease of removal of detachable strap 80 by an operator. Detachable strap 80 may be made of any suitable flexible material having adequate compressive strength to prevent inadvertent tightening of end cap 24, such as, for example, a pliable plastic or metal strip. When the operator pulls on pull-tab 22, detachable band 80 breaks and peels away from barrel 12. A suitable legend is provided so as to instruct the operator regarding the proper method of firing the device.

Figure 4:
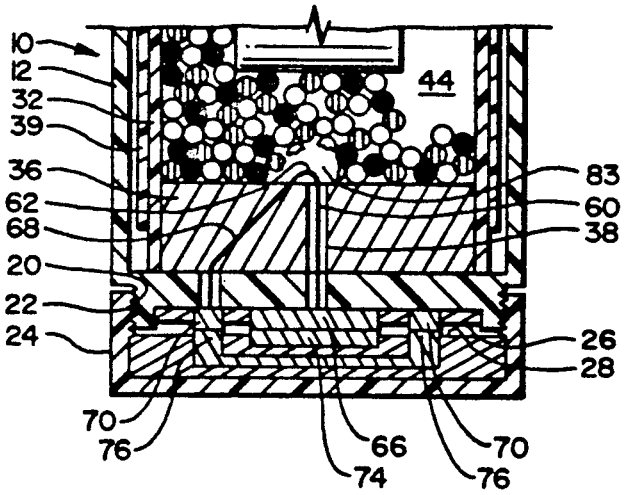
FIG. 4 is a longitudinal sectional view of the portion of the device shown in FIG. 3, immediately following ignition of the propellant charge of the device.

With reference now to FIG. 4, there is shown a sectional view of the end of the device shown in FIG. 3, taken along a central axis thereof, at the moment of ignition of propellant charge 44. With reference to FIG. 4, it will be seen that the removable strap has been removed from around the threads 20 on the lower end of barrel 12. End cap 24 has then been tightened against the lower end of barrel 12 by an operator. As end cap 24 was tightened, surface 26 on barrel 12 and surface 28 on end cap 24 moved towards each other until the contacts thereon came into abutment with one another. Thus, it will be seen that contact 74 of the battery assembly is in abutment with contact 66, which is electrically connected to first end 64 of ignitor wire 60. Similarly, contact 76 (on the other pole of the battery assembly) is in abutment with contact 70, which is electrically connected to second end 68 of ignitor wire 60, so that a complete circuit is formed from the first pole of the battery assembly through the ignitor wire to the second pole of the battery assembly. The flow of current through ignitor wire 60 causes middle portion 62 of ignitor wire 60 to become hot, thereby igniting propellant charge 44. A combustion zone 83 is initiated, which will subsequently progress longitudinally through propellant charge 44. The expanding of gases released by ignited propellant charge 44 exit the lower end of shell casing 32, either by passing through and eroding orifice 38, or by blowing out end plug 36, thereby causing the shell assembly to move upwardly and be launched from barrel 12.

Figure 5:
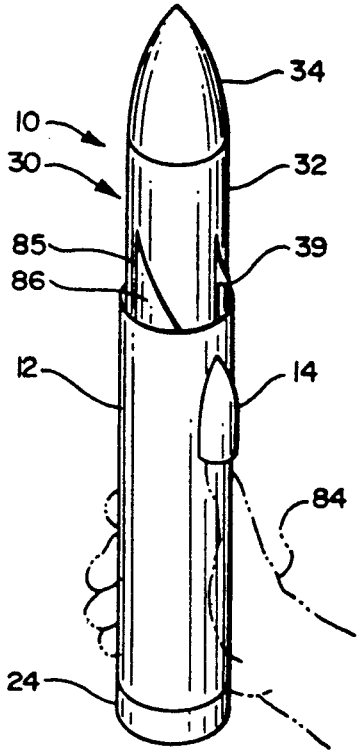
FIG. 5 is a perspective view of the device of FIG. 1, showing the emergence of the shell from within the barrel as it is launched therefrom.

With reference now to FIG. 5, there is seen a perspective view of the emergency signalling device 10 of the present invention, as was previously described with reference to FIGS. 1 through 4, as shell assembly 30 is launched from within barrel 12. FIG. 5 shows barrel 12 having thumbstop 14 and end cap 24 mounted thereon. Barrel 12 is, at this point, grasped in a hand of an operator, as indicated by broken line image 84, with the thumb pointed skyward and in abutment with the thumbstop 14. Shell assembly 30 is seen exiting the upper end of barrel 12. It will be noted that nose cap 34 and shell casing 32, in combination, preferably form an aerodynamic shape suitable for flight through the atmosphere. Furthermore, it will be seen that fins 39 each have a base portion 85 which is mounted to shell casing 32 and a flexible blade portion 86. Each base portion 84 preferably has an elongate edge which is mounted longitudinally along shell casing 32. Each flexible blade portion 86, as will be seen with reference to FIG. 5, is preferably folded flush against the circumference of shell casing 32 (between shell casing 32 and barrel 12) for compact storage and protection from damage. In the view shown in FIG. 5, the lower edges of flexible blade portions 86 of the emerging shell assembly 30 are still retained within barrel 12, and consequently flexible blade portions 86 still lie generally flush against the side of shell casing 32.

Figure 6:
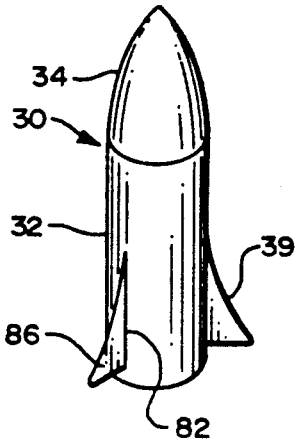
FIG. 6 is a perspective view of the shell of the device shown in FIG. 5, following its launch from the barrel of the device.

With reference now to FIG. 6, there is shown a perspective view of shell assembly 30, following completion of its launch from the barrel of the device of the present invention. With reference to FIG. 6, it will be seen that stabilizing fins 39 have been completely released from the barrel; consequently, flexible blade portions 86, which may preferably be spring steel or flexible plastic, have been released to spring outwardly, so that stabilizing fins 39 extend substantially radially from shell casing 32. In this configuration, stabilizing fins 39 serve to effectively stabilize shell assembly 30 as it is projected upwardly by the burning propellant charge. It should be noted that, while stabilizing fins 39 shown in FIG. 6 have a suitable triangular shape, a wide variety of other shapes of fins (or alternative stabilizing appendages, such as a tail stick) may be adapted to the present invention to serve the desired stabilization function. Further more, one skilled in the art may find it desirable to modify nose cap 34 and shell casing 32 to any of a wide variety of suitable shapes, without departing from the scope of the present invention.

It is to be recognized that these a various other modifications could be made to the illustrative embodiments without departing from the spirit and scope of the present invention. Accordingly, the invention is not to be limited except as by the appended claims.

What is claimed and desired to be secured by Letters Patent of the United States is:

1. An emergency signalling device, said device comprising:

a generally elongate shell;

a combustible propellant charge enclosed within said shell for propelling said shell aloft when ignited;

means for igniting said propellant charge;

means for generating a visible smoke trail from said shell as said shell is propelled aloft;

means for generating a visible spark trail from said shell as said shell is propelled aloft;

means for generating an audible report from said shell once said shell is propelled aloft beyond a predetermined altitude;

a multiplicity of radar chaff particles enclosed within said shell; and means for distributing said radar chaff particles from said shell once said shell is propelled aloft beyond a predetermined altitude.

2. The signalling device of claim 1, wherein said means for generating a visible smoke trail comprises combustible smoke-generating material interspersed within said propellant charge.

3. The signalling device of claim 2, wherein said means for generating a visible trail of sparks comprises a multiplicity of particles of magnesium interspersed within said propellant charge.

4. The signalling device of claim 2, wherein said means for generating an audible report comprises at least one explosive charge.

5. The signalling device of claim 4, wherein said at least one explosive charge is encased within said propellant charge so that said explosive charge is discharged from said shell as said shell is propelled aloft by said ignited propellant charge.

6. The signalling device of claim 5, wherein said at least one explosive charge has a combustible fuse which is exposed within said propellant charge, so that said explosive charge is ignited as said explosive charge is discharged from said shell.

7. The signalling device of claim 1, wherein said shell further comprises a nose compartment at an upper end of said shell for encasing said multiplicity of radar chaff particles within said shell.

8. The signalling device of claim 7, wherein said means for distributing said multiplicity of radar chaff particles from said shell comprises an explosive ejection charge for ejecting said particles of radar chaff from said nose compartment.

9. The signalling device of claim 8, wherein said explosive ejection charge is mounted in said shell intermediate said propellant charge and said nose compartment at said upper end of said shell, said explosive ejection charge having a lower face which is in contact with said propellant charge so that said ejection charge is ignited when said propellant charge has been substantially depleted in the course of propelling said shell aloft.

10. The signalling device of claim 1, further comprising a barrel for launching said shell, said barrel having a substantially cylindrical bore for enclosing said shell, said cylindrical bore having a substantially open upper end for exit of said shell upon said launching and a substantially closed lower end.

11. The signalling device of claim 10, further comprising a stop mounted exterior to said barrel for reacting against a hand of an operator, so as to prevent recoil of said barrel which results from said launching of said shell from driving said barrel through said hand of said operator.

12. The signalling device of claim 11, wherein said stop comprises a lateral extension mounted on said exterior of said barrel for reacting longitudinally against a thumb of said hand of said operator.

13. The signalling device of claim 10, further comprising a plurality of stabilizing fins mounted exterior to said shell for stabilizing said shell as said shell is propelled aloft.

14. The signalling device of claim 13, wherein each said stabilizing fin comprises a base portion mounted to said shell and a flexible blade portion, said flexible blade portion being folded against said exterior of said shell intermediate said shell and said barrel, so that flexible blade portion is released and extends radially from said shell as said shell is launched from said barrel.

15. The signalling device of claim 10, wherein said means for igniting said propellant charge comprises:

an ignitor wire having a first end electrically connected to a first electrical contact, a second end electrically connected to a second electrical contact, and a middle portion which is in contact with said propellant charge;

a battery having a first pole electrically connected to a third electrical contact and a second pole electrically connected to a fourth electrical contact;

means for maintaining a gap between at least one said electrical contact connected to said ignitor wire and at least one said electrically contact connected to said battery prior to said ignition of said propellant charge; and manually operable means for closing said at least one gap so as to complete an electrical circuit from said first pole of said battery to said second pole of said battery through said ignitor wire, whereby said middle portion of said ignitor wire which is in contact said propellant charge is heated so as to ignite said propellant charge.

16. The signalling device of claim 15, further comprising:

a first transverse bulkhead mounted at said lower end of said barrel, said first bulkhead having an inner surface facing towards said propellant charge and an outer surface facing away from said propellant charge, said outer surface of said first bulkhead having said first and second electrical contacts mounted thereon; and a second transverse bulkhead mounted to said lower portion of said barrel so as to be movable relative to said first bulkhead, said second bulkhead having an inner surface facing towards said outer surface of said first bulkhead, said inner surface of said second bulkhead having said third and fourth electrical contacts mounted thereon so that said third and fourth contacts are spaced apart from said first and second contacts prior to said ignition of said propellant charge.

17. The signalling device of claim 16, wherein said lower portion of said barrel is provided with external threads, and said manually operable means for closing said gap comprises an end cap having internal threads in threadable engagement with said threads on said barrel, and having said second transverse bulkhead mounted therein, so that said end cap is tightenable against said lower portion of said barrel by an operator so as to bring said first contact into abutment with said third contact and said second contact into abutment with said fourth contact.

18. The signalling device of claim 17, wherein said means for maintaining said at least one gap prior to said ignition comprises:

a removable band mounted circumferentially about said external threads on said barrel so as to prevent said tightening of said end cap against said barrel; and a pull tab attached to said strap for removal of said strap from said threads by said operator.

19. An emergency signalling device, said device comprising:

a substantially cylindrical barrel having an upper end sealed by a pierceable membrane and an externally threaded lower end sealed by a transverse bulkhead;

a substantially cylindrical shell enclosed within said barrel, said shell having an upper end closed by a generally conical nose cap and a lower end closed by a base plug, said base plug having a longitudinal orifice therethrough;

a multiplicity of particles of chaff enclosed within said conical nose cap;

an explosive ejection charge mounted within said shell proximate the base of said conical nose cap for distributing said chaff particles from said shell;

a combustible propellant charge enclosed within said shell intermediate said ejection charge and said base plug for propelling said shell aloft when ignited;

combustible smoke-generating material interspersed in said propellant charge for generating a smoke trail from said shell as said shell is propelled aloft;

combustible spark-generating material interspersed in said propellant charge for generating a spark trail from said shell as said shell is propelled aloft;

at least one explosive charge for generating a report once said shell has been propelled aloft beyond a predetermined altitude, said report-generating charge being embedded in said propellant charge and having an ignitable fuse exposed to said propellant charge, so that said report-generating charge is ignited and ejected by said propellant charge as said shell is propelled beyond said predetermined altitude;

an ignitor wire having a middle section in contact with a lower end of said propellant charge, said ignitor wire having a first end which is electrically connected to a first contact and a second end which is electrically connected to a second contact, said first and second contacts being mounted on an outer surface of said lower bulkhead;

a substantially cylindrical end cap having threads in threadable engagement with said thread lower end of said barrel, said end cap having a transverse interior surface which is opposed to said exterior surface of said bulkhead; and a battery mounted in said end cap, said battery having a first pole which is electrically connected to a third contact and a second pole which is electrically connected to a fourth contact, said third and fourth contacts being mounted on said interior surface of said end cap, so that as said end cap is tightened against said lower end of said barrel by an operator, said third contact will come into abutment with said first contact and said fourth contact will come into abutment with said second contact.

20. The signalling device of claim 19, wherein said at least one report-generating charge comprises:

a first report-generating explosive charge embedded in said propellant charge a sufficient distance from said base plug so that said first report-generating explosive charge is ignited and ejected by said ignited propellant charge as said shell is propelled aloft beyond a first predetermined altitude; and a second report-generating explosive charge embedded in said propellant charge a sufficient distance from said base plug to that said second report-generating explosive charge is ignited and ejected by said ignited propellant charge as said shell is propelled aloft beyond a second predetermined altitude which is above said first predetermined altitude.

21. The signalling device of claim 19, further comprising:

a plurality of stabilizing fins, each said fin having a base portion mounted to the exterior of said shell, and a flexible blade portion folded circumferentially intermediate the exterior of said shell and the interior of said barrel, so that said flexible blade portions of said stabilizing fins are released and extend radially from said shell as said shell is launched from said barrel.

* * * * *